US006145737A

United States Patent [19]

Imai et al.

[11] Patent Number: 6,145,737

[45] Date of Patent: Nov. 14, 2000

[54] AUTOMATIC TELLER APPARATUS

[75] Inventors: Masayuki Imai; Kenichi Nashirozawa; Kazuto Kitano; Naomi Hori, all of Kanagawa, Japan

[73] Assignee: Fujitsu Limited, Kanagawa, Japan

[21] Appl. No.: 09/185,713

[22] Filed: Nov. 4, 1998

Related U.S. Application Data

[63] Continuation-in-part of application No. 09/053,493, Apr. 2, 1998, Pat. No. 6,012,633.

[30] Foreign Application Priority Data

Apr. 13, 1998 [JP] Japan ..... 10-101398

[51] Int. Cl.[7] ..... B65D 91/00

[52] U.S. Cl. ..... 232/1 D; 232/15; 232/16; 235/379; 902/9

[58] Field of Search ..... 232/1 D, 4 R, 232/15, 16, 43.1; 235/379; 902/8, 9; 109/24.1, 66; 194/350

[56] References Cited

U.S. PATENT DOCUMENTS

| | | | |
|---|---|---|---|
| 4,602,332 | 7/1986 | Hirose et al. | 235/379 X |
| 5,454,332 | 10/1995 | Fennelly et al. . | |
| 5,673,333 | 9/1997 | Johnston . | |
| 5,833,132 | 10/1998 | Bachmeier et al. | 232/43.1 X |
| 5,900,607 | 5/1999 | Awatsu et al. . | |

*Primary Examiner*—Lynne H. Browne
*Assistant Examiner*—William L. Miller
*Attorney, Agent, or Firm*—Armstrong, Westerman Hattori, McLeland & Naughton

[57] ABSTRACT

A check is fed to a storage mechanism through a check carrier path. The storage mechanism carries the check to a check carrier unit by an operation of a gate mechanism. The check carrier unit carries the check as far as a storage box with carrier rollers. The check is discharged from the check carrier unit and stored in the storage box. The storage box is provided outside a safe. The storage box is detachably provided and has a cylinder lock provided on the door thereof.

10 Claims, 16 Drawing Sheets

AUTOMATIC TELLER APPARATUS

PRIOR APPLICATION

The instant patent application is a continuation-in-part of U.S. patent application Ser. No. 09/053,493, filed Apr. 2, 1998 now U.S. Pat. No. 6,012,633.

FIELD OF THE INVENTION

The present invention relates to an automatic teller apparatus, and more particularly to an automatic teller apparatus which can easily collect particular monetary documents, such as checks.

BACKGROUND OF THE INVENTION

In areas, such as the USA, where a large number of checks are used, the volume of dealing with checks per day reaches several tens of thousands. This dealing with checks is conventionally carried out in the back of an office, such as a facility dedicated to dealing with checks, which requires enormous personnel expenses. Therefore, an apparatus adding thereto a function of receiving a single slip of check in addition to a function of dealing with paying-in with an envelope is used for a current automatic teller apparatus. A received check is stored, together with an envelope, in a storage section of a paying-in section.

FIG. 14 is a front view showing an example of an automatic teller apparatus. In this automatic teller apparatus 500, a customer operating section 1 comprises a display section 11 for displaying thereon an operation guide screen, a switch 12 for selecting an item of the screen 11, and entry keys 13 for entering an identification number and an amount of money. A card operating section 2 reads in, when having received a user's card, contents of the card. The card operating section 2 returns, after the processing for read-in is terminated, the card to the user.

An envelope discharging section 3 discharges an envelope when a user selects the processing for paying-in with an envelope. The envelope is a formatted type with entry columns thereon, such as a name, an account no., and an mount of money in the envelope. A pay-out processing section 4 discharges a specified amount of cash when a user selects the processing for paying-out. An envelope input port 5 (receiving port) receives an envelope or a check inputted by a user.

FIG. 15 is a rear-side perspective view showing the automatic teller apparatus shown in FIG. 14. A safe 506 is provided in the lower section of the automatic teller apparatus 500. Provided in the safe 506 is a pay-in processing section 600. The pay-in processing section 600 is constructed as a single unit by itself. The safe 506 is made of a special steel plate having a thickness of 12.7 mm because envelopes and checks are stored in the safe 506. A combination lock 562 is used for a door 561 of the safe 506.

Provided in the pay-in processing section 600 is a bin 601 for storing therein envelopes and checks. An enclosure of this bin 601 is made of a steel plate having a thickness of 2 mm. A cylinder lock is provided on a door 602 of the bin 601. Also, accommodated in the upper section of the automatic teller apparatus 500 are units not dealing with cash and checks, such as a display unit, a card carrier mechanism, a card recognizing unit (each of them is not shown in the figure). Provided on a door 502 of a cabinet 501 for accommodating therein those units is a comparatively simpler lock, such as a cylinder lock 503.

FIG. 16 is an explanatory view showing carrier paths in the automatic teller apparatus 500 shown in FIG. 15. Provided on the cabinet 501 for the safe 506 is a shared inserting port 564 for envelopes and checks. The shared inserting port 564 has receiving rollers 611 arranged therein. A switch lever 613 is located at the immediate downstream side from the receiving rollers 611. The switch lever 613 activates by a magnetic solenoid (not shown) to switch between an envelope carrier path 650 and a check carrier path 660.

The envelope carrier path 650 has a plurality of carrier rollers 651. The internal section of the bin 601 is divided into an envelope storage section 604 and a check storage section 605. The envelope carrier path 650 extends up to the envelope storage section 604. An envelope is carried to the envelope storage section 604 for the bin 601 through the envelope carrier path 650.

Provided in the check carrier path 660 is a magnetic sensor 662. This magnetic sensor 662 senses the presence or absence of a character string for an MICR (magnetic-ink character reader) pre-printed on a check. When the MICR-character string cannot be sensed, the check is returned. Provided also in the check carrier path 660 are three aligning rollers 663. A reversing gate 664 is provided on the downstream side from the rollers. The reversing gate 664 operates by electromagnetic solenoids (not shown).

A first carrier path 660*a* and a second carrier path 660*b* are connected to each other at this reversing gate 664. The second carrier path 660*b* comprises a plurality of carrier rollers 665 and an MICR-reader 669. The MICR-reader 669 reads an MICR-character string on a check. The storage mechanism 680 stores a check on the first carrier path 660*a* in a specified position in the bin 601. The reversing gate 664 introduces any check from the first carrier path 660*a* to the second carrier path 660*b*. When introduced to the second carrier path 660*b*, the check is reversed.

A function for collecting checks, or the like, in a safe and a function for maintaining them outside the safe are required for an ordinary type of automatic teller apparatus. The maintenance function is a function for exchanging consumable articles, or the like. For example, the exchange of consumable articles in a receipt printer, as well as in a journal printer, of ink ribbons, and of bank books corresponds to that function. This maintenance function is generally carried out at least once a day. On the other hand, the collecting function is a function for collecting checks, or the like, in a bin, and includes operations, such as exchange of cash cassettes and collection of reject boxes. This collecting function is generally carried out about once a week.

Also, a simple lock, such as a cylinder lock 503, is used for a lock on the door 502 of a cabinet provided outside the safe because cash is not stored in any place outside the safe. On the other hand, cash in envelopes is stored in the safe 506, so that a firm and complicated lock, such as a combination lock 562, is provided on the door 561 of the safe 506. The lock is usually placed under strict controls by a person in charge.

However, if an MICR-character string on a check is read once by a unit, such as a MICR-reader, and then reception information is printed thereon, the security for the check as strict as that for cash is not needed. Accordingly, if checks are collected, for example, together with the maintenance function, a time required for payment processing for the checks can be reduced, which allows circulation of checks to be enhanced. However, in the conventional type of automatic teller apparatus 500, checks are stored in the safe 506 having a complicated and firm lock 562, so that time and effort are needed to open or close the door 561.

SUMMARY OF THE INVENTION

It is an object of the present invention to provide an automatic teller apparatus which can easily collect particular monetary documents, such as checks.

For the purpose of achieving the object described above, an automatic teller apparatus according to the present invention has a storage section for formatted envelopes, checks, and other monetary documents, and automatically transacts a monetary document with a customer without the assistance of an attendant, in which the storage section comprises a first storage section, which is easily opened/closed or attached/detached, and a second storage section, which is harder to be opened/closed than at least the first storage section, and stores particular monetary documents in the first storage section thereof.

When particular monetary documents, such as checks and applications for transfer, are stored in the first storage section, which is easily opened/closed or attached/detached, the checks are easily collected. On the other hand, important documents, such as cash, may be stored in the second storage section which is harder to be open/closed.

An automatic teller apparatus according to the present invention has a storage section for formatted envelopes, checks, and other monetary documents and automatically transacts a monetary document with a customer without the assistance of an attendant, in which the storage section comprises a first storage section with a simple lock provided on a door thereof, and a second storage section with a firm and complicated lock provided on a door thereof, and stores particular monetary documents in the first storage section thereof.

The first storage section has a simple lock provided on the door thereof. For this reason, if particular monetary documents, such as checks and applications for transfer, are stored in this first storage section, the monetary documents are easily collected. The second storage section has a firm and complicated lock provided on the door thereof, so that cash, or the like, is stored in the second storage section.

An automatic teller apparatus according to the present invention has a hand-operated lock unit provided on the door of the first storage section in place of the simple lock.

The hand-operated lock unit is provided on the door of the first storage section in place of the simple lock. As a result, similarly to the case where a simple lock is provided thereon, by storing particular monetary documents, such as checks and applications for transfer, in the first storage section, the monetary documents are easily collected.

An automatic teller apparatus according to the present invention comprises a main carrier section for carrying formatted envelopes, checks, and other monetary documents; and auxiliary carrier section for carrying particular monetary documents among the monetary documents; a first storage section connected to the auxiliary carrier section for storing therein particular monetary documents and being easily opened/closed or attached/detached; and a second storage section connected to the main carrier section for storing therein monetary documents other than the particular monetary documents and hard to be opened/closed than at least the first storage section; and the apparatus automatically transacts a monetary document with a customer without the assistance of an attendant.

The particular monetary documents, such as checks and applications for transfer, among the monetary documents are carried by the auxiliary carrier section to be stored in the first storage section. The first storage section is easily opened or closed as well as attached or detached, so that checks, or the like, can easily be collected. For this reason, a maintenance serviceman can more easily carry out collection of checks. The monetary documents other than the particular monetary documents, such as cash, are directly stored separately from the main carrier section in the second storage section. The second storage section is harder to be opened or closed than the first storage section. Cash, or the like, is collected in the ordinary collecting manner.

An automatic teller apparatus according to the present invention comprises a main carrier section for carrying formatted envelopes, checks, and other monetary documents; an auxiliary carrier section branching from the main carrier section for carrying particular monetary documents among the monetary documents; a first storage section connected to the auxiliary carrier section for storing therein particular monetary documents and having a simple lock provided on a door thereof; and a second storage section connected to the main carrier section for storing therein monetary documents other than the particular monetary documents and having a firm and complicated lock provided on a door thereof; and the apparatus automatically transacts a monetary document with a customer without the assistance of an attendant.

The first storage section has a simple lock provided on the door thereof. For this reason, if particular monetary documents, such as checks and applications for transfer, are stored in this first storage section through the auxiliary carrier section, the monetary documents are easily collected. The second storage section has a firm and complicated lock provided on the door thereof, so that cash, or the like, is stored in the second storage section through the main carrier section.

The automatic teller apparatus according to the present invention further comprises a main carrier section controller for controlling operations of the main carrier section; and an auxiliary carrier section controller for controlling operations of the auxiliary carrier section in correlation to the operations of the main carrier section.

The auxiliary carrier section carries particular monetary documents, but the particular monetary documents are also carried by the main carrier section. For this reason, the auxiliary carrier section is controlled in correlation to the operations of the main carrier section. For example, when a check is carried by the main carrier section, fed to the auxiliary carrier section at some midpoint in the carrier, and carried by the auxiliary carrier section, the auxiliary carrier section is operated at the time immediately before the check arrives.

The automatic teller apparatus according to the present invention has an impeller with a plurality of blades each made of an elastic body with high friction provided in the radial direction of a rotor and contacting the blades with a monetary document further provided in the auxiliary carrier section.

With rotation of the impeller, the check being carried and the blades thereof are contacted with each other. As each of the blades comprises an elastic body with high friction, the check is accurately carried by the blades.

The automatic teller apparatus according to the present invention has a de-electrifying brush for removing static electricity built up on the monetary document further provided in the auxiliary carrier section.

If particular monetary documents, such as checks, are built up with static electricity, the documents may be directed to any place other than the storage section. By providing the de-electrifying brush therein, the checks are not directed to any other places even if they have been electrified.

An automatic teller apparatus according to the present invention comprises an inserting port for inserting therein formatted envelopes, checks, and other monetary documents; a first carrier section for carrying particular monetary documents, such as a check; a second carrier section for carrying monetary documents other than the particular monetary documents, such as the envelope; a switch lever for switching between the first carrier section and the second carrier section each provided behind the inserting port; a storage section provided at the end of the second carrier section; a safe for holding at least the storage section inside thereof; an opening section provided on the wall of the safe or on the door thereof; an auxiliary carrier section branching from the first carrier section and reaching the opening section; a storage box provided outside the safe and detachably attached to the opening section for storing therein particular monetary documents; and a control section for controlling operations of the first and second carrier sections, switch lever, and of the auxiliary carrier section.

The first carrier path and the second carrier path are switched by the switch lever. The first carrier path carries particular monetary documents, such as checks. The second carrier path carries monetary documents other than the particular monetary documents. As the second carrier path leads to the storage section, monetary documents other than the particular monetary documents are stored in this storage section. The particular monetary documents are carried to the storage box provided outside the safe through the first carrier path and second carrier path.

An automatic teller apparatus according to the present invention comprises an inserting port for inserting therein formatted envelopes, checks, and other monetary documents; a first carrier section for carrying particular monetary documents, such as a check; a second carrier section for carrying monetary documents other than the particular monetary documents, such as the envelope; a switch lever for switching between the first carrier section and the second carrier section each provided behind the inserting port; a control section for controlling operations of the first and second carrier sections, and of the switch lever; a storage section provided at the end of the second carrier section; a safe for holding at least the storage section inside thereof, an opening section provided on the wall of the safe or on the door thereof; an auxiliary carrier section branching from the first carrier section and reaching the opening section; a dedicated control section provided in the auxiliary carrier section for controlling operations of the auxiliary carrier section; and a storage box provided outside the safe and detachably attached to the opening section for storing therein particular monetary documents.

The auxiliary carrier section is controlled by the dedicated control section. For this reason, the auxiliary carrier section and the dedicated control section can be handled as one unit. Also, if connected to the control section, the auxiliary carrier section can be operated in accordance with operations of other devices. By discretely controlling the auxiliary carrier section, as described above, the auxiliary carrier section can be attached and detached for exchange thereof.

Other objects and features of this invention will become understood from the following description with reference to the accompanying drawings.

DESCRIPTION OF THE PREFERRED EMBODIMENTS

Detailed description is made hereinafter of the automatic teller apparatus according to the present invention with reference to the related drawings. It should be noted that the present invention is not limited to this embodiment.

Figure 1:
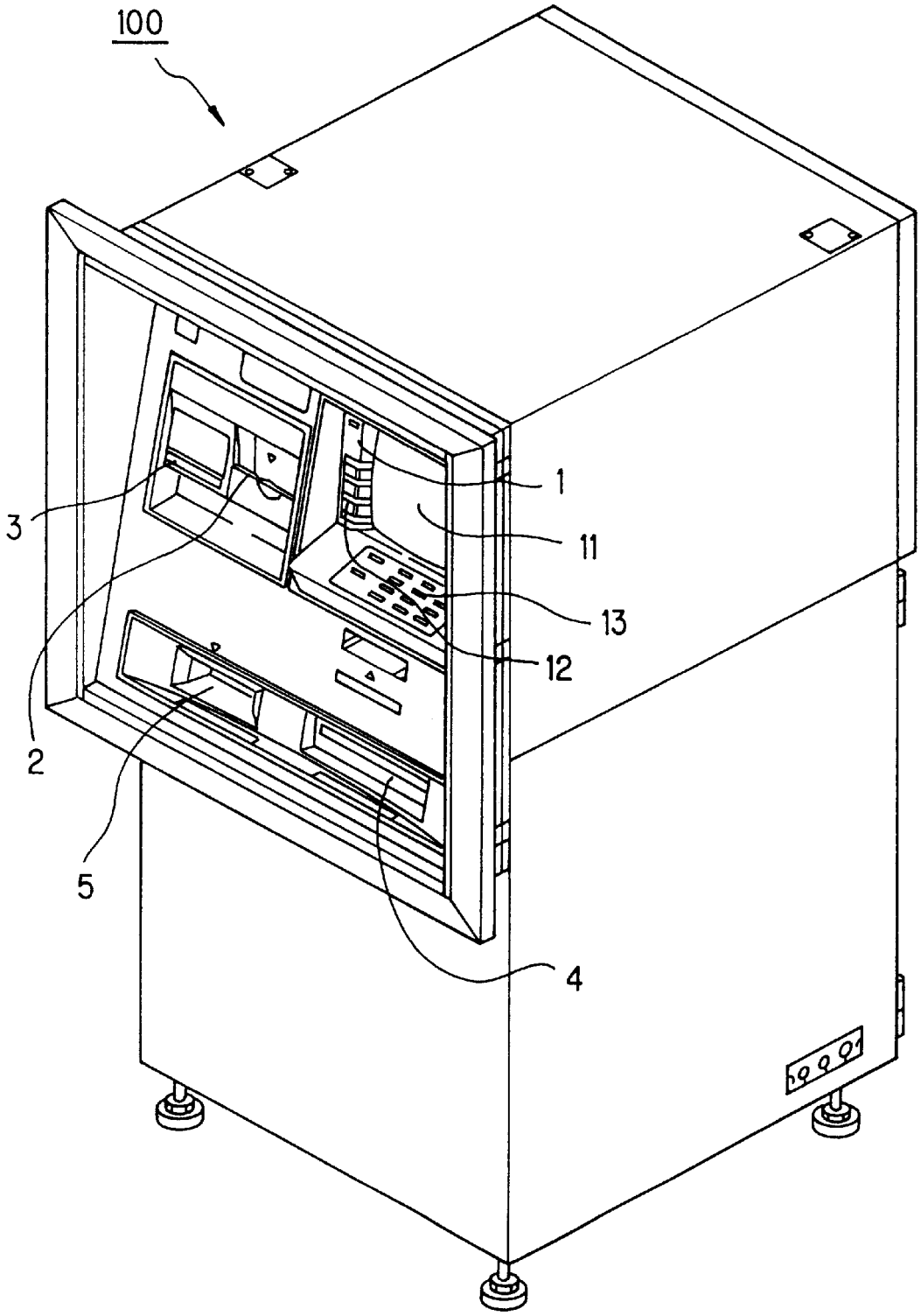
FIG. 1 is a perspective view showing the automatic teller apparatus according to the embodiment of the present invention.

FIG. 1 is a perspective view showing the automatic teller apparatus according to the embodiment of the present invention. In this automatic teller apparatus 100, a customer operating section 1 comprises a display section 11 for displaying an operation guide screen, switches 12 each for selecting an item on the screen, and entry keys 13 for entering data such as an identification number and an amount of money.

A card operating section 2 reads, when having received a user's card, contents of the card. The card operating section 2 returns, after the processing for read-in is terminated, the card to the user. An envelope discharging section 3 discharges an envelope when a user selects the processing for paying-in with an envelope. A pay-out processing section 4 discharges a specified amount of cash when a user selects the processing for paying-out. An envelope input port 5 (receiving port) receives an envelope or a check put in by a user.

Figure 2:
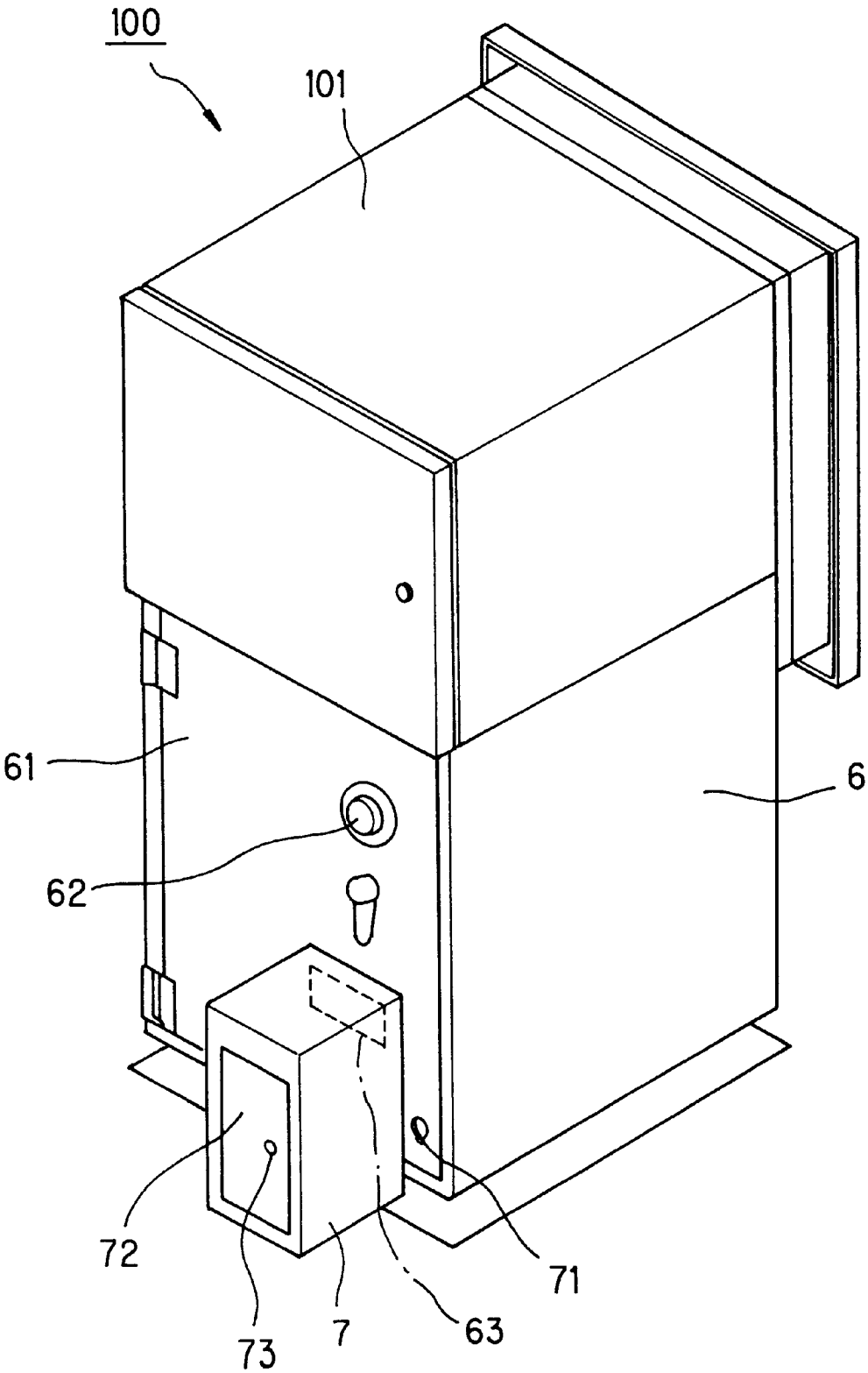
FIG. 2 is a rear-side perspective view showing the automatic teller apparatus shown in FIG. 1.

FIG. 2 is a rear-side perspective view showing the automatic teller apparatus shown in FIG. 1. A safe 6 is provided in the lower section of the automatic teller apparatus 100. The safe 6 is integrated with a cabinet 101 of the apparatus. The safe 6 is made of a special steel plate having a thickness of 12.7 mm. A combination lock 62 is provided on a door 61 of the safe 6.

The lock provided on the door 61 of the safe 6 is not limited to the combination lock on condition that the lock is so firm and complicated that it is hard to be opened or closed. For example, a security container key lock and a delayed-action time lock may be used. It should be noted that a firm lock indicates any lock of which construction is hard to be damaged or which is made of a material difficult to be machined. A complicated lock indicates any lock having a large number of digits as a key number or being obtained by combining various types of key with each other.

Further, an opening section 63 is provided on the door of the safe 6. Attached to this opening section 63 is a storage box 7 for storing therein checks. The storage box 7 is detachably provided and engaged with the door 61 of the safe 6 with a cylinder lock 71. The storage box 7 is made of a steel plate having a thickness of around 2 mm.

Provided on the door 72 of the storage box 7 is a locking cylinder 73. The lock provided on the door 72 of the storage box 7 is not limited to the cylinder lock 73 on condition that the lock is simple and can easily be opened and closed. For example, a cabinet locking cylinder and a door lock may be used. A simple lock indicates any lock having a simple construction as well as a small number of digits (e.g., three digits) of a lock number. If a maintenance side of the automatic teller apparatus, namely the rear side of the apparatus is isolated from a customer and security of the apparatus can sufficiently be insured, a hand-operated lock unit, such as a knob, may be provided in place of the lock on the door of the storage box 7.

Figure 3:
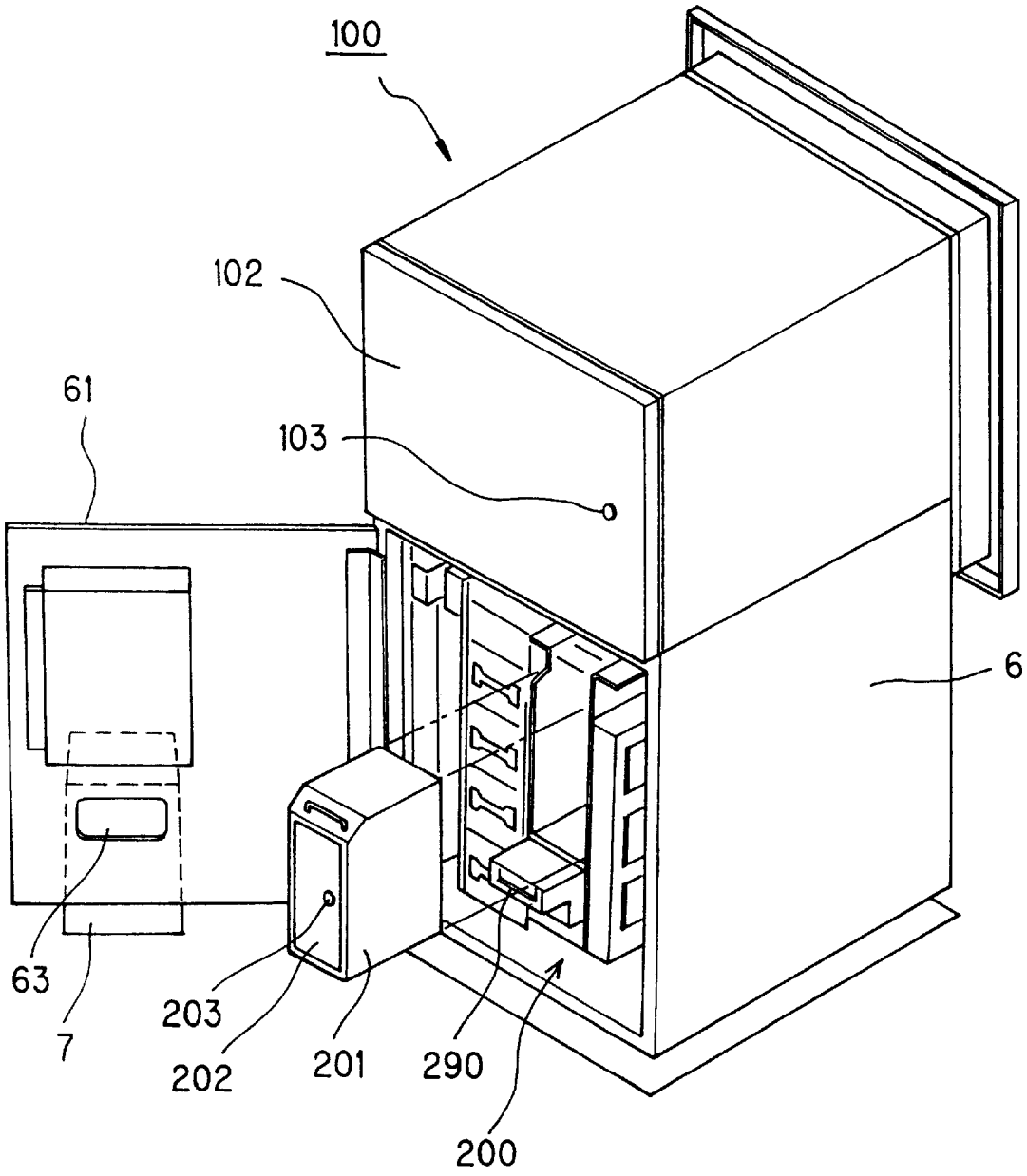
FIG. 3 is a perspective view showing a state where the door of the safe for the automatic teller apparatus shown in FIG. 1 is opened.

FIG. 3 is a perspective view showing a state where the door 61 of the safe 6 is opened. A pay-in processing section 200 is located in the safe. The pay-in processing section 200 is constructed as a single unit by itself.

Provided in the pay-in processing section is a bin 201 for storing therein envelopes. An enclosure of this bin 201 is made of a steel plate having a thickness of 2 mm. A comparatively simpler lock, such as a cylinder lock 203, is provided on a door 202 of the bin 201. Also, a check carrier unit 290 is located below the bin 201. This check carrier unit 290 is described in detail later.

Accommodated in the upper section of the automatic teller apparatus are, on the other hand, units not dealing with cash and checks, such as a display unit, a card carrier mechanism, a card recognizing unit (each of them is not shown in the figure). Provided on a door 102 of a cabinet 101 for accommodating therein those units is a cylinder lock 103. The lock provided on the door 102 of the cabinet 101 is not limited to the cylinder lock on condition that the lock is simple and easily opened or closed. For example, cylinder lock and a door lock may be used.

Figure 4:
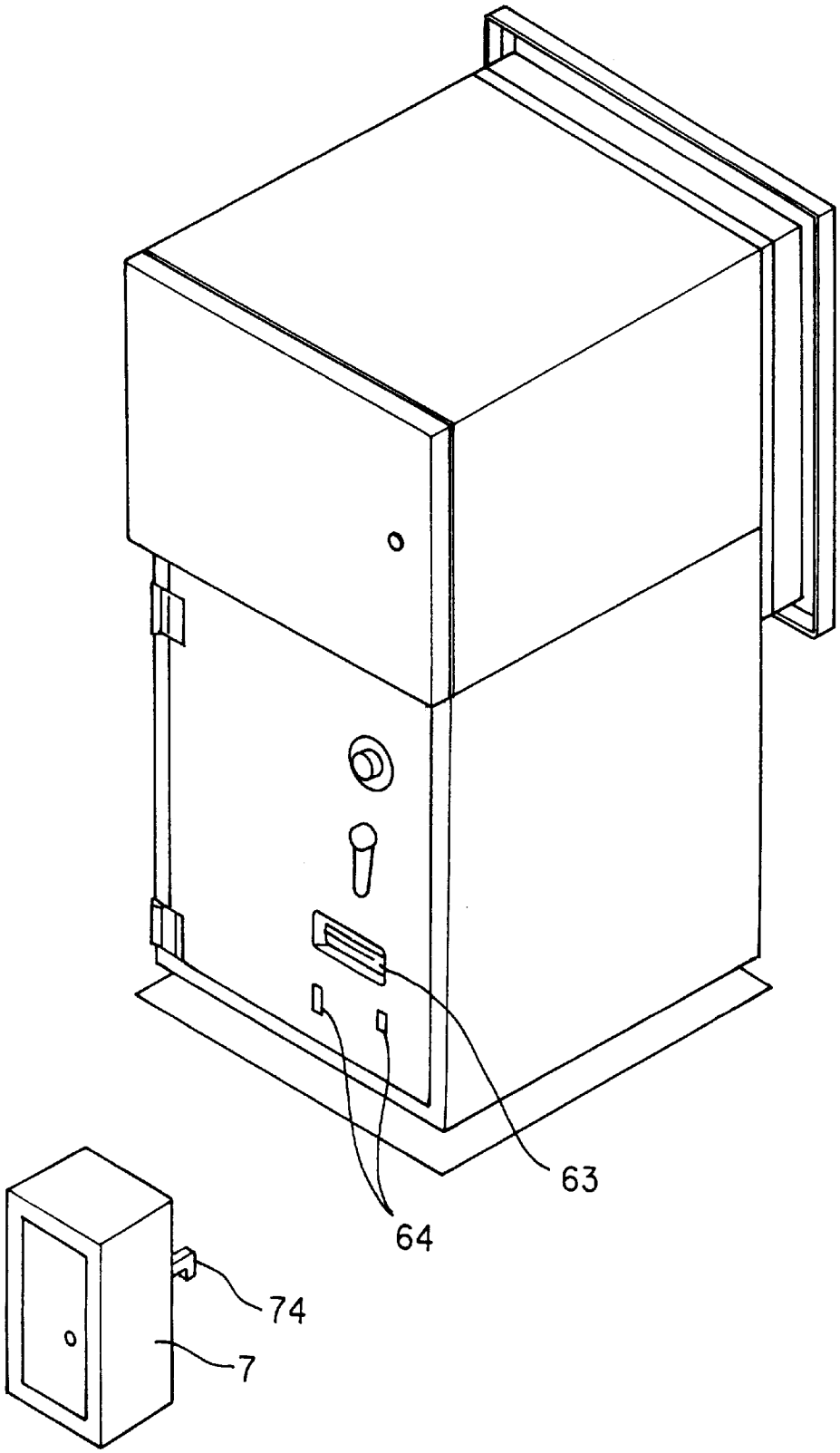
FIG. 4 is a perspective view showing a state where the storage box of the automatic teller apparatus shown in FIG. 1 has been detached therefrom.

FIG. 4 is a perspective view showing a state where the storage box 7 has been detached from the door. Provided below the opening section 63 are long holes 64 in which key sections 74 on the storage box are engaged, and the storage box is locked with a cylinder lock 71. In order to detach the storage box 7 from the door, locking with the cylinder lock 71 may be unlocked. The lock used for fixing the storage box 7 thereto is not limited thereto if it is simple. For example, a cylinder lock and a hand-operated lock lever may be used. Also, the storage box may be fixed with a clamping unit using a fixing tool, such as screws.

Figure 5:
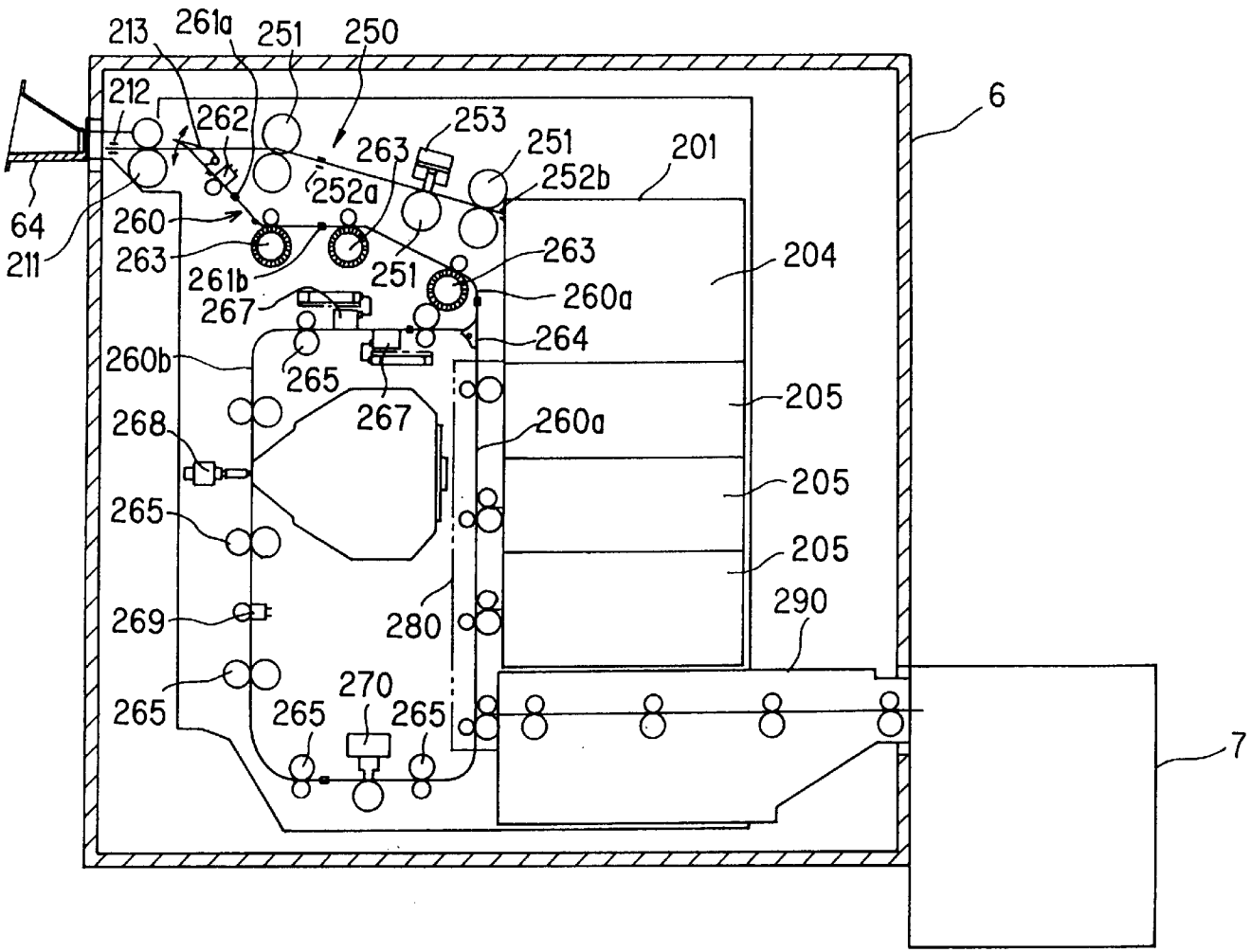
FIG. 5 is an explanatory view showing carrier paths in the automatic teller apparatus shown in FIG. 1.

FIG. 5 is an explanatory view showing carrier paths in the automatic teller apparatus 100. Provided on the cabinet for the safe 6 is a shared inserting port 64 for envelopes and checks. The shared inserting port 64 has receiving rollers 211 arranged therein. A transmission type of sensor 212 is located on the immediate upstream side from the receiving rollers 211. A switch lever 213 is located on the immediate downstream side from the receiving rollers 211.

The switch lever 213 activates by a magnetic solenoid (not shown) to switch between an envelope carrier path 250 and a check carrier path 260. The envelope carrier path 250 has a plurality of carrier rollers 251, a transmission type of sensor 252*a,* and an envelope printing mechanism 253 for printing reception information on an envelope. The internal section of the bin 201 is divided into an envelope storage section 204 for storing therein envelopes and a check storage section 205 separately provided from the storage box 7 for storing therein checks.

The envelope carrier path 250 extends up to the envelope storage section 204. The envelope printing mechanism 253 subjects an envelope to printing. The printed envelope is carried to the envelope storage section 204 for the bin 201 and stored therein.

The transmission type of sensors 212 and 252*a* sense a size of an envelope. When a transmission type of sensor 252*b* is ON at the point of time the transmission type of sensor 212 is OFF, it is determined that the length of a check exceeds a maximum limit, and the check is returned. Similarly, when a transmission type of sensor 252*a* is OFF at the point of time the transmission type of sensor 212 is OFF, it is determined that the length of a check is less than a minimum limit, and the check is returned.

Provided along the check carrier path 260 are a transmission type of sensor 261*a* or 261*b* and a magnetic sensor 262. This magnetic sensor 262 senses presence or absence of a character for an MICR (magnetic-ink character reader), pre-printed on a check. When the MICR-character string cannot be sensed, the check is returned. For example, when a check is inserted in its wrong orientation or when a check with no MICR-character string thereon is inserted, the inserted check is returned.

When a transmission type of sensor 261*b* is ON at the point of time the transmission type of sensor 212 is OFF, it is determined that the length of a check exceeds a maximum limit, and the check is returned. Similarly, when a transmission type of sensor 261*a* is OFF at the point of time the transmission type of sensor 212 is OFF, it is determined that the length of a check is less than a minimum limit, and the check is returned.

Provided also in the check carrier path 260 are three aligning rollers 263 each made of a petal-shaped rubber material. A check is aligned with a reference guide (not shown) by these aligning rollers 263. A reversing gate 264 is provided on the downstream side from the rollers.

The reversing gate 264 operates by the electromagnetic solenoids (not shown). A first carrier path 260*a* and a second carrier path 260*b* are connected to each other at this reversing gate 264. The second carrier path 260*b* has a loop shape and comprises a plurality of carrier rollers 265, an image scanner 267, an MICR encoder 268, an MICR-reader 269, a check printing mechanism 270, and a storage mechanism 280.

The carrier rollers 265 carries a check while giving the check a weak aligning force. With this operation, the check can be carried while the alignment executed in the first carrier path 260*a* is being kept up. The image scanner 267 optically reads in the top surface or rear surface of the check. The MICR-encoder 268 prints an MICR-character string on an MICR column of the check with magnetic ink. The MICR-reader 269 magnetically reads in the MICR-character string on the check.

The check printing mechanism 270 prints, in a wire-dot method, reception information (AUDIT) on a check and prints for an endorsement on the check. The storage mechanism 280 sorts out checks on the first carrier path and stores each of the checks in a specified position in the bin 201. The reversing gate 264 introduces checks on the first carrier path 260*a* to the second carrier path 260*b*. By introducing each of the checks to the second carrier path 260*b*, the check can be reversed.

Figure 6:
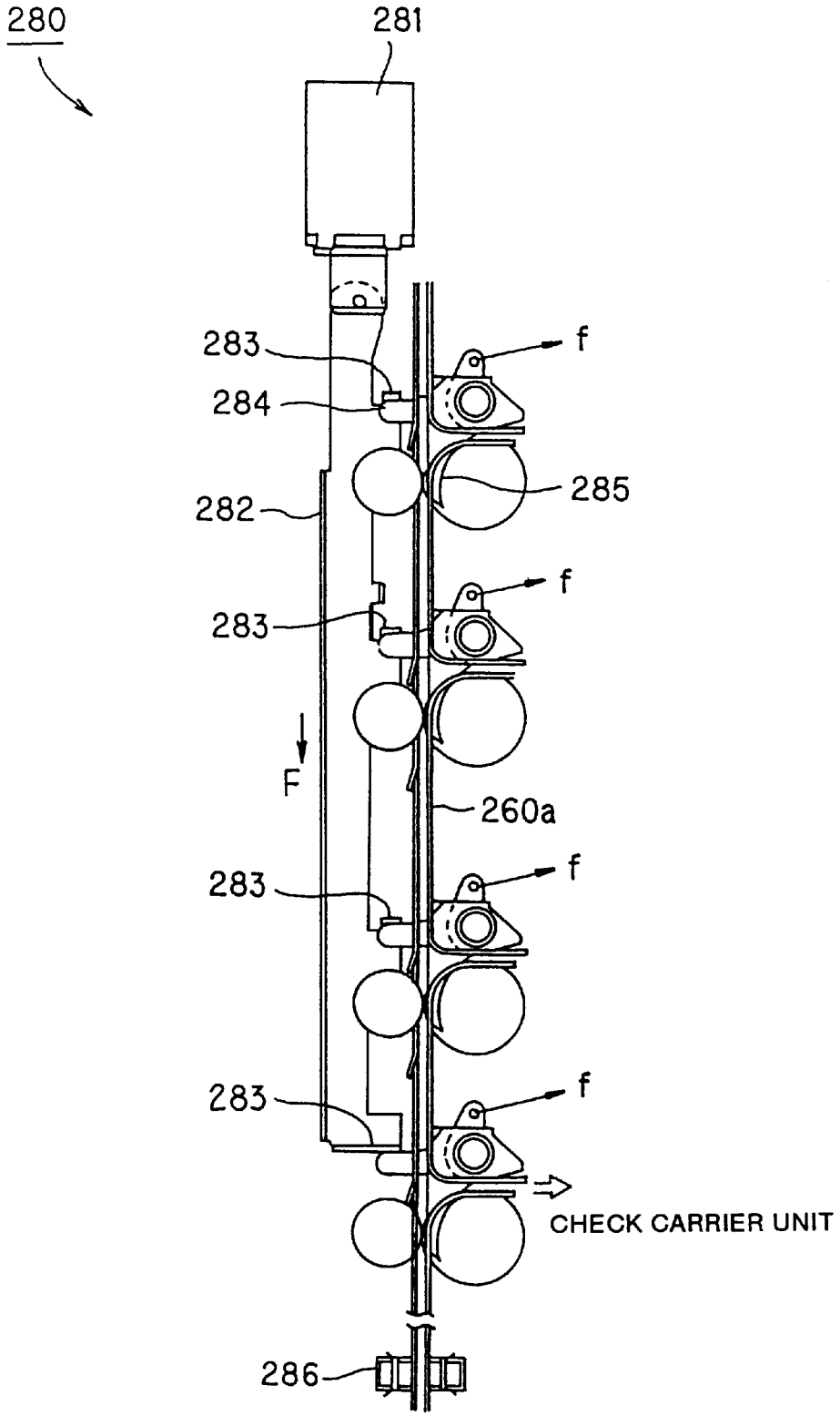
FIG. 6 is a view showing a construction of the storage mechanism shown in FIG. 5.

FIG. 6 is a view showing a construction of the storage mechanism 280 shown in FIG. 5. A driving lever 282 is connected to the electromagnetic solenoid 281. The driving lever 282 has four hitting sections 283. The driving lever mechanism 282 is energized in the F direction in the figure. A transmission type of sensor 286 is provided in the entrance of the storage mechanism 280.

The driving lever 282 is energized in the F direction in the figure. Accordingly, when the electromagnetic solenoid 281 is not energized, each hitting section 283 of the driving lever 282 hits against each lever 284 of the gate mechanisms. Accordingly, each gate 285 of the gate mechanism is recessed from the first carrier path 260*a*. On the other hand, when the electromagnetic solenoid 281 is energized, the driving lever 282 is pulled. Accordingly, the hit caused by the driving lever 282 against the lever is released, and the lever 284 of each of the gate mechanisms is also released.

The gate 285 of each of the gate mechanism is projected, because it is energized in the f direction in the figure by a spring (not shown), to the first carrier path 260*a* by means of the action of the spring. In this storage mechanism 280, transmission of a check is sensed by a transmission type of sensor 286, and if an energizing timing of the electromagnetic solenoid 281 is controlled according to this sensed signal, the check can be stored in a particular check storage section. The lowest gate mechanism feeds a check to a check carrier unit 290.

Figure 7:
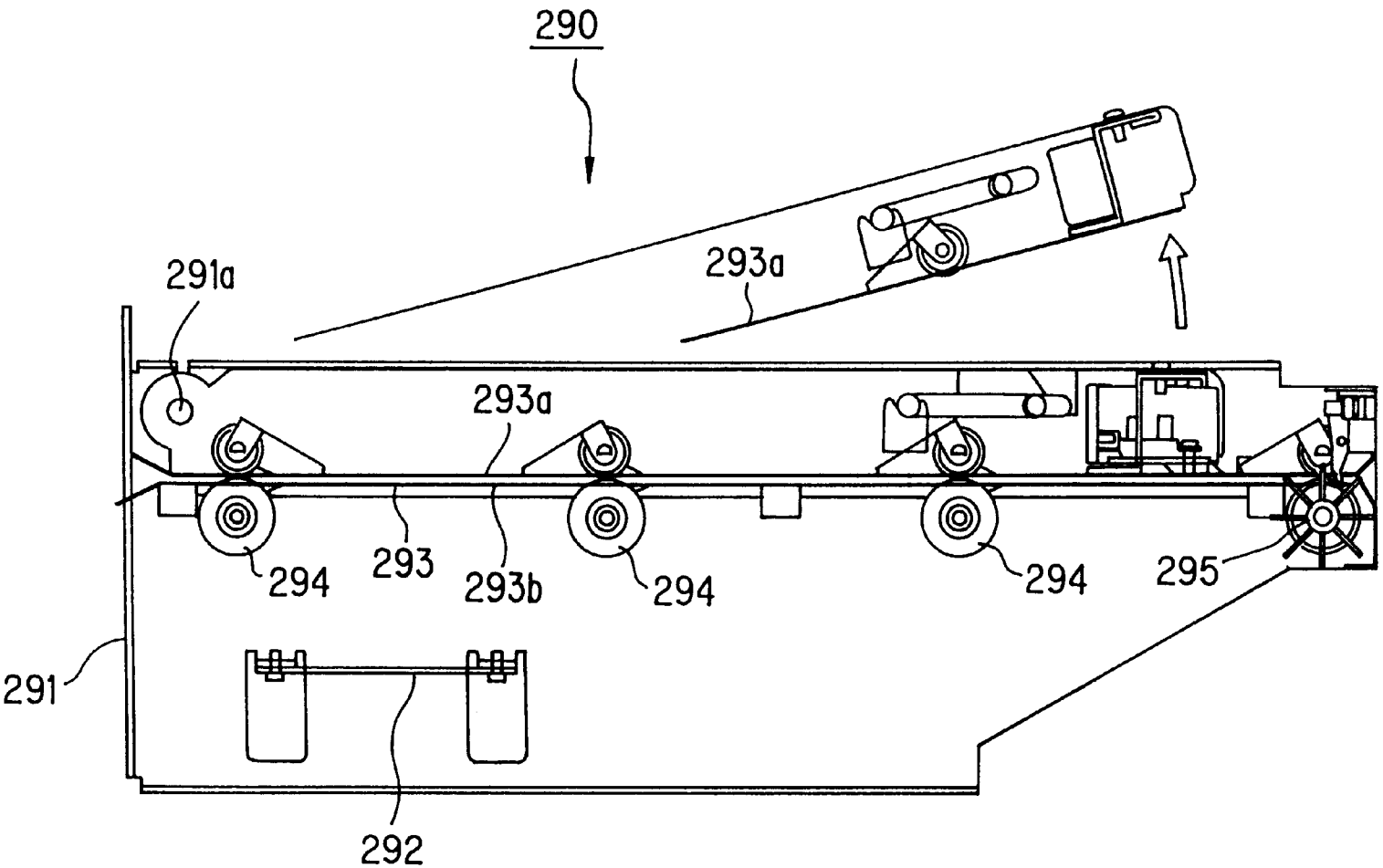
FIG. 7 is a view showing a construction of the check carrier unit shown in FIG. 5.

FIG. 7 is a view showing a construction of the check carrier unit 290. A body cabinet 291 of the check carrier unit 290 becomes a reference face for attachment to the storage mechanism 280. The check carrier unit 290 is screwed and fixed to the safe 6. Located inside the cabinet 291 is driver base 292 dedicated to the check carrier unit.

The check carrier unit 290 comprises a carrier guide 293 and three pieces of carrier rollers 294. Both edges of the carrier guide 293 are fork-shaped. That is because jam due to a curl of a check, or the like, at the guide edge sections will not occur. Provided at the end of the carrier path is an impeller 295 for throwing checks down into the storage box 7.

Figure 8:
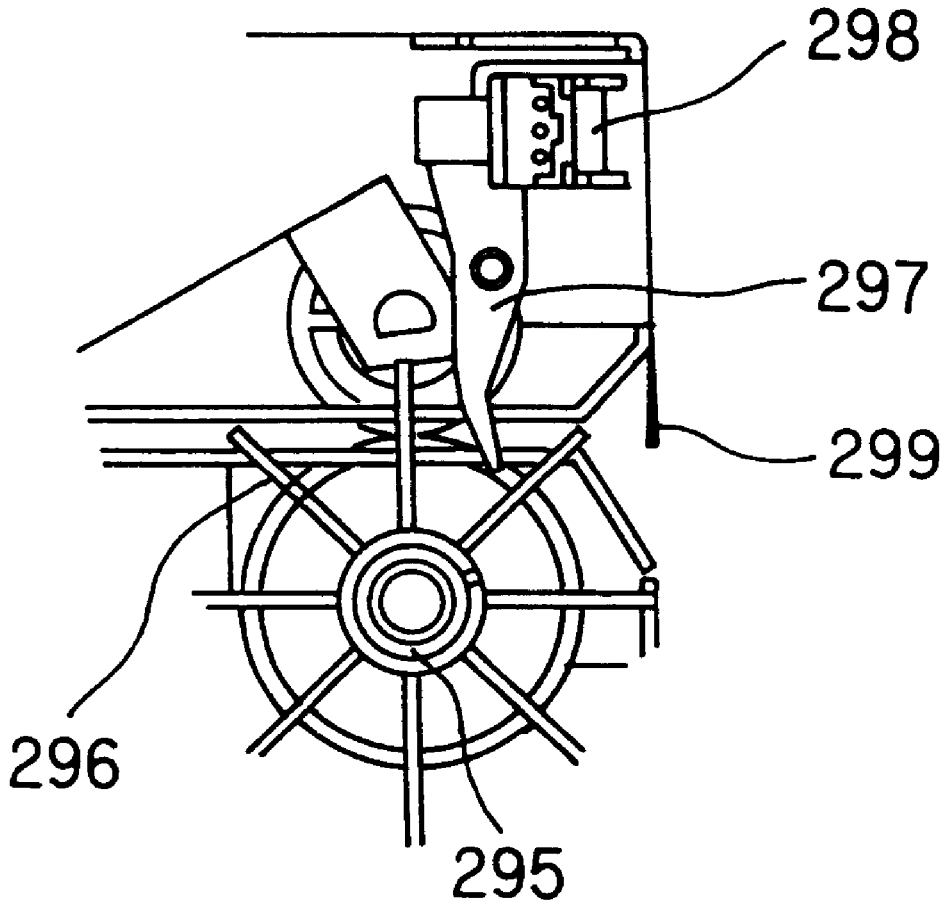
FIG. 8 is an enlarged view showing the portion around the impeller in FIG. 7.

FIG. 8 is an enlarged view showing the portion around the impeller in FIG. 7. Each blade 296 of the impeller 295 is made of an elastic body, such as rubber with high friction. The blades 296 of the impeller 295 carry with friction a check having been sent as far as the storage box 7 and accurately stores the check therein. It should be noted that the material of the blade 296 is not limited to rubber as far as it is an elastic body with friction. The blade may be made of, for example, resin with rubber provided outside thereof. A lever 297 is located in the immediate downstream side from the impeller 295. This lever 297 is activated when a check is passing therethrough, which is sensed by a sensor 298. It is understood by output from the sensor that the check has been stored therein.

A brush 299 for removal of static electricity is provided at a check discharge port of the check carrier unit 290. The brush is provided because, when a check is built up with static electricity, the check may be adhered to the body cabinet 291 or some other places of the check carrier unit 290. It should be noted that the body cabinet 291 can be opened at a supporting point of rotation 291*a* as a center between an upper guide 293*a* and the lower guide 293*b*. That construction enables freeing when a jammed check is collected.

Figure 9:
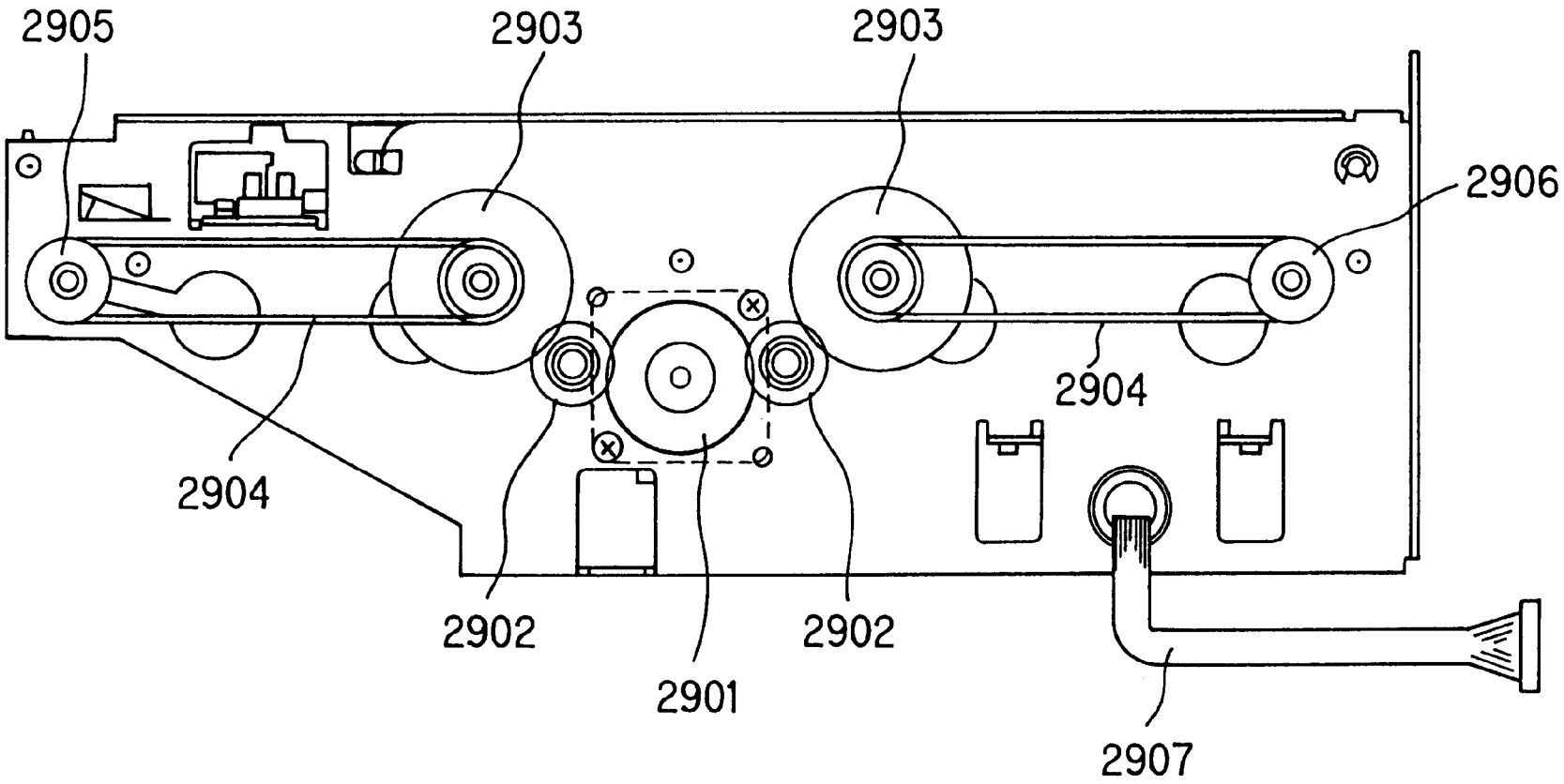
FIG. 9 is an explanatory view showing a driving mechanism of the check carrier unit shown in FIG. 7.

FIG. 9 is an explanatory view showing a driving mechanism of the check carrier unit 290. The carrier rollers 294 and the impeller 295 are driven by a drive motor 2901. Turn of the drive motor 2901 is conveyed to driving wheels 2903 each through an intermediate wheel 2902. The driving wheels 2903 and the carrier rollers 294 are coaxial for rotation, so that the carrier rollers 294 are rotated together with the driving wheels 2903.

Turn of the driving wheels 2903 is connected to an input-side driving wheel 2905 as well as to a driving wheel 2906 of the impeller 295 each through a timing belt 2904. A cable 2907 connects a control section for the apparatus described later to a driver base 292.

Figure 10:
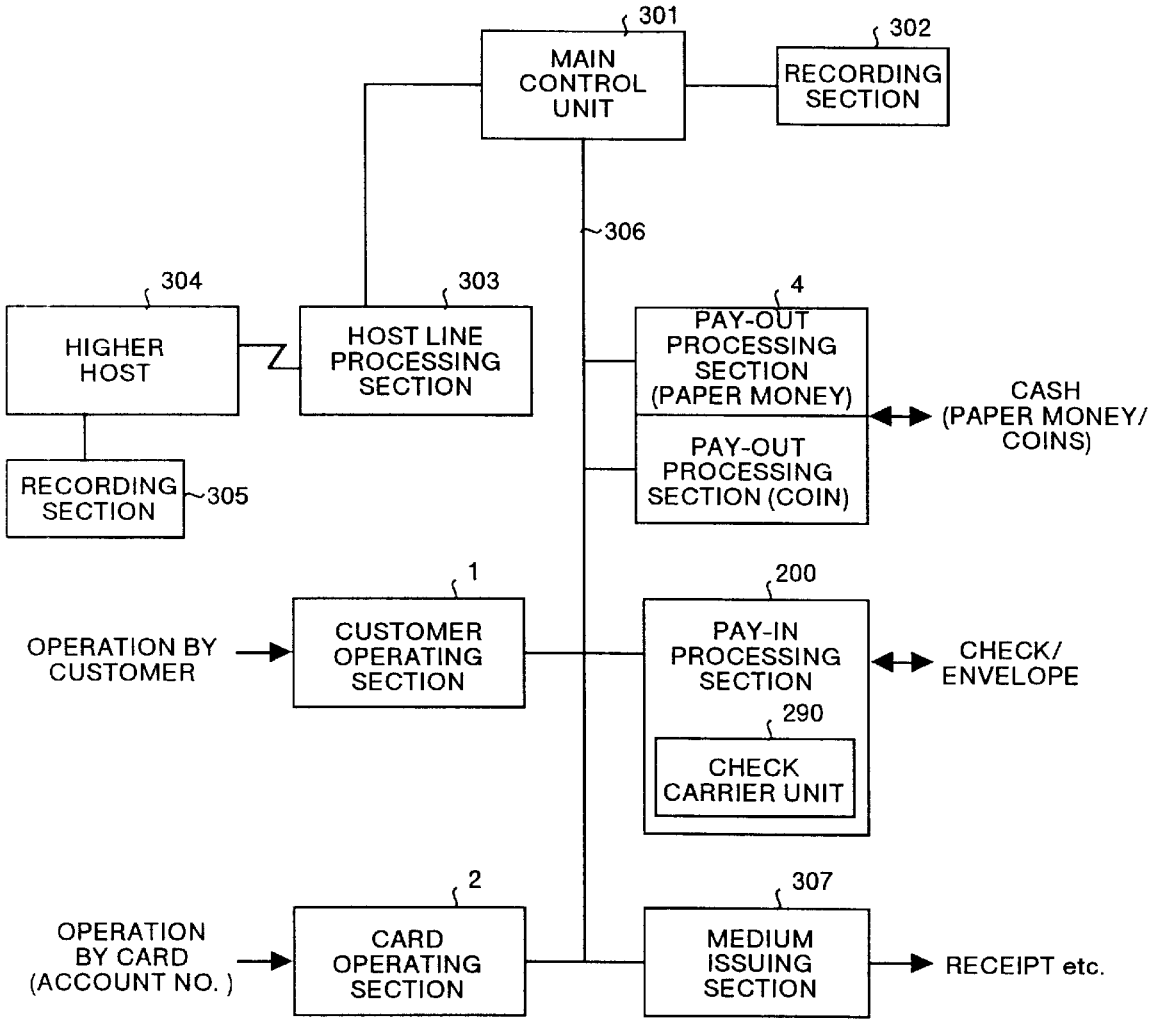
FIG. 10 is a block diagram showing the configuration of the automatic teller apparatus.

FIG. 10 is a block diagram showing the configuration of this automatic teller apparatus. A recording section 302 is connected to a main control section 301. The recording section 302 records therein a program and data for the main control section 301. The main control section 301 is connected to a host line processing section 303. The host line processing section 303 executes communications with a higher host computer 304. Connected to the higher host computer 304 is also a recording section 305 with a control program recorded therein.

The customer operating section 1 and the card operating section 2 in FIG. 1 are connected to the main control section 301 through a bus 306. The pay-out processing section is connected to the main control section 301 through the bus 306. The pay-out processing section 4 prepares two parts for paper money and coins. A medium issuing section 307 issues a receipt, or the like, with transacted contents printed thereon. The medium issuing section 307 is connected to the main control section 301 through the bus 306.

The pay-in processing section 200 processes envelopes, checks and other monetary documents each inserted from the receiving port 5. The configuration of the pay-in processing section 200 will be described when description is made for FIG. 11. The pay-in processing section 200 is connected to the main control section 301 through the bus 306. Also, the pay-in processing section 200 has the check carrier unit 290.

Figure 11:
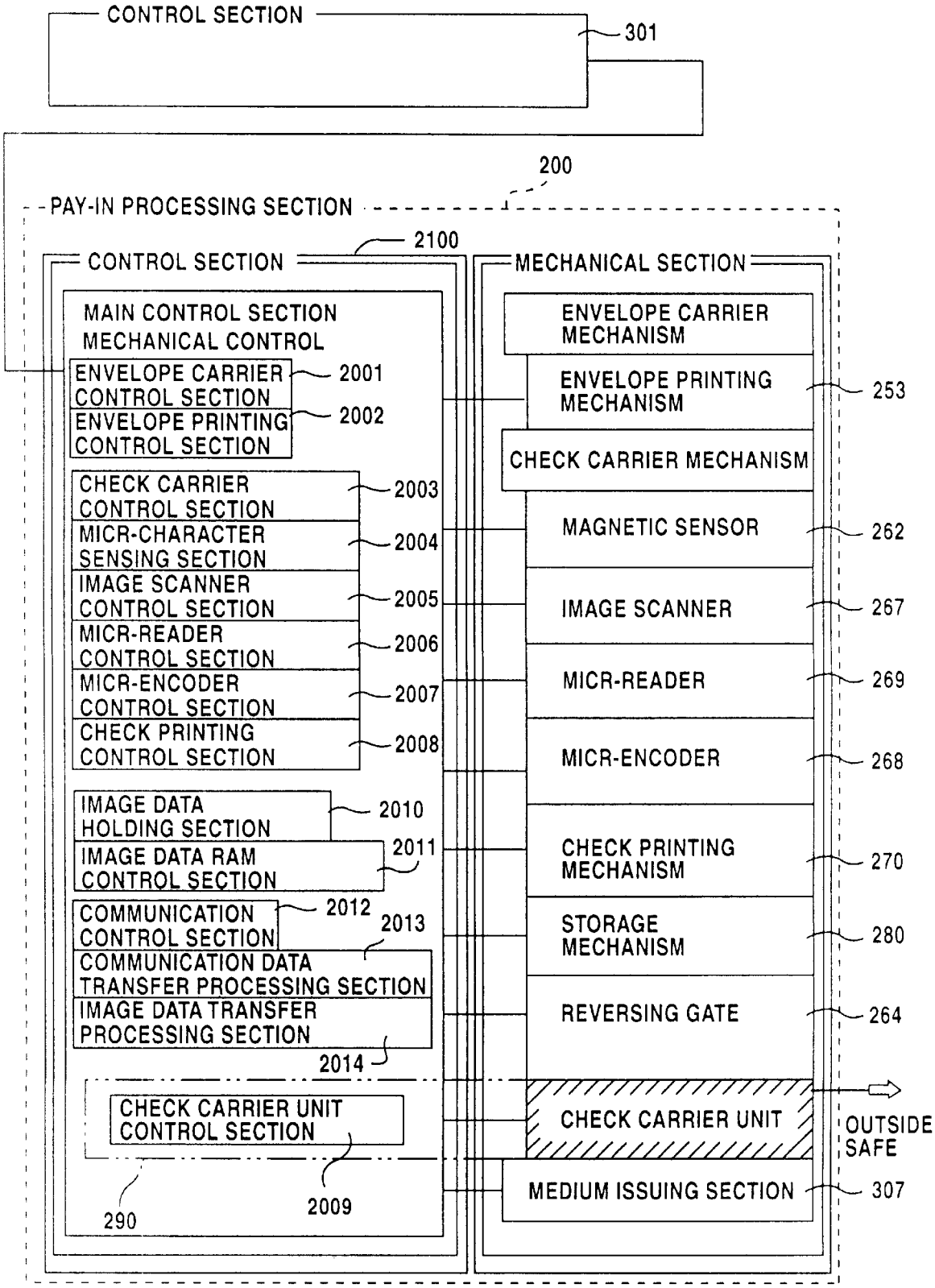
FIG. 11 is a block diagram functionally showing the pay-in processing section shown in FIG. 3.

FIG. 11 is a block diagram functionally showing the pay-in processing section 200. The pay-in processing section 200 has a control section 2100. This control section 2100 comprises a microprocessor. The control section 2100 also comprises an envelope carrier control section 2001, an envelope printing control section 2002, a check carrier control section 2003, an MICR-character sensing section 2004, an image scanner control section 2005, an MICR-reader control 2006, an MICR-encoder control section 2007, and a check printing control section 2008.

The control section 2100 has a check carrier unit control section 2009 for controlling the check carrier unit 290. The check carrier unit control section 2009 is formed on the driver base 292 in the check carrier unit 290, and connected to the side of the control section through the cable 2907.

Further, the control section 2100 has an image data holding section 2010. The image data holding section 2010 comprises, for example, a RAM. Provided in the image data holding section 2010 is an image data RAM control section 2011 for controlling the RAM.

The control section 2100 also has a communication control section 2012 for controlling communications with the higher host computer 304 connected thereto through the main control section 301. The communication control section 2012 comprises a communication data transfer processing section 2013 for transferring communication data, and an image data transfer processing section 2014 for transferring image data.

The envelope carrier control section 2001 controls an envelope carrier mechanism in the envelope carrier path 250. The envelope carrier mechanism includes carrier rollers 251 shown in FIG. 5 and in addition, comprises a guide (not shown) and a drive motor (not shown). The envelope printing mechanism 253 on the envelope carrier path 250 is controlled by the envelope printing control section 2002. The check carrier mechanism includes the aligning rollers 263 and carrier rollers 265 shown in FIG. 5, and in addition, comprises a guide (not shown) and a drive motor (not shown). This check carrier mechanism is controlled by the check carrier control mechanism 2003.

The magnetic sensor 262 shown in FIG. 5 is controlled by the MICR-character sensing section 2004. The image scanner 267 shown in FIG. 5 acquires an image of a check according to an instruction by the image scanner control section 2005, and sends the image to the main control section 301. The MICR-reader 269 magnetically reads an MICR-character string on the check according to an instruction by the MICR-reader control section 2006, and sends the read character to the main control section 301. The MICR-encoder 268 prints an MICR-character string onto the check under controls by the MICR-encoder control section 2007.

The check printing mechanism 270 prints a character string onto the check under controls by the check printing control section 2008. The storage mechanism 280 either stores the check in a specific position of the bin 201 or feeds the check to the check carrier unit 290 under controls by the check carrier control section 2003. The reversing gate 264 reverses the check upside down under control by the check carrier control section 3. The check carrier unit 290 carries the check as far as the storage box 7 provided outside the safe under control by the check carrier unit control section 2009. The check carrier unit 290 is controlled in association with the storage mechanism 280.

Figure 12:
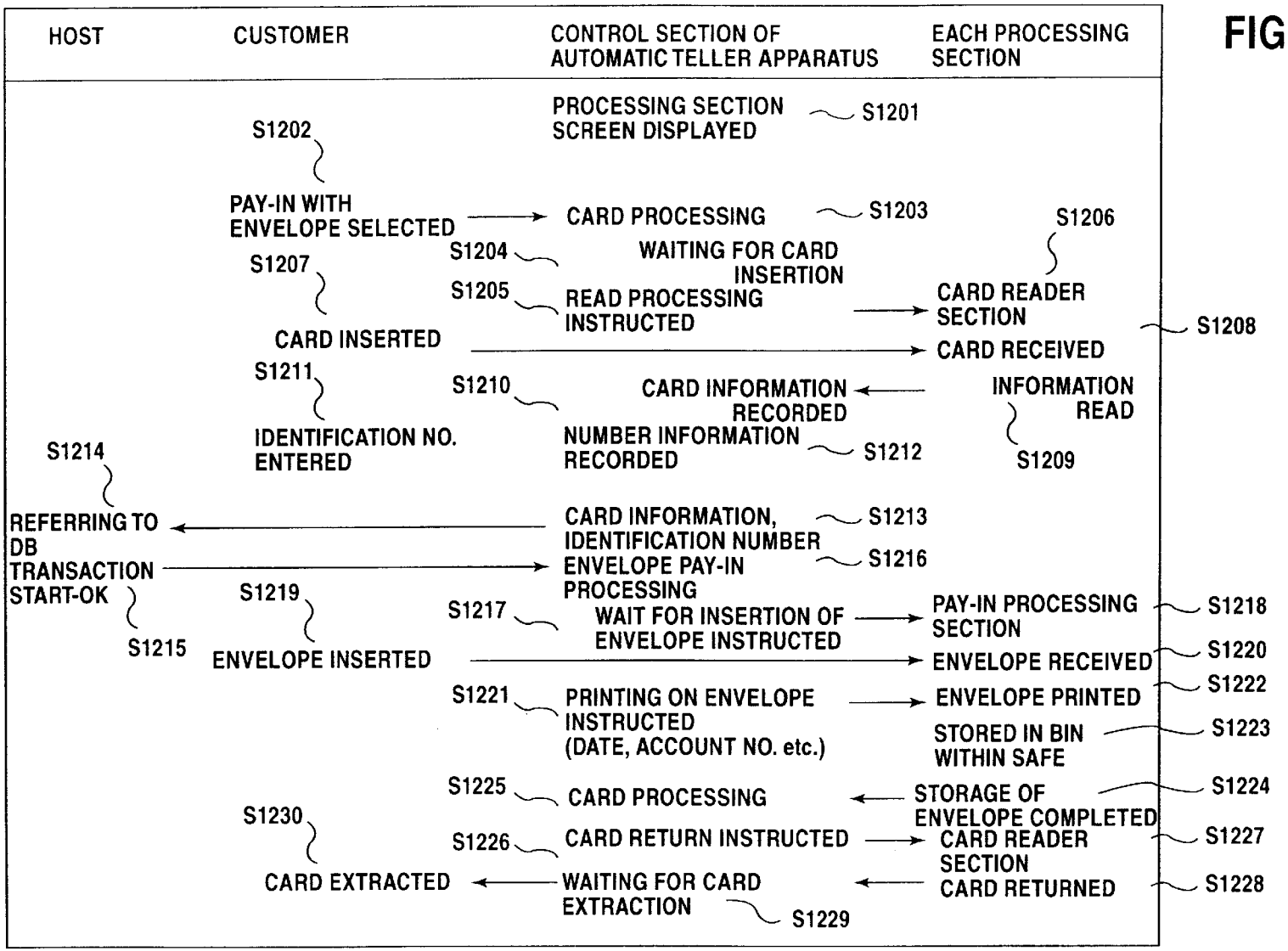
FIG. 12 is a flow chart showing the pay-in processing with an envelope among the sequence of processing in the automatic teller apparatus.

FIG. 12 is a flow chart showing the pay-in processing with an envelope among the sequence of processing in the automatic teller apparatus 100. Shown in the figure from the left column are the sequence of processing in the higher host computer 304, the sequence operated by a customer, the sequence of processing executed by the control section for the automatic teller apparatus 100, and the sequence of processing executed by each processing section. When a customer selects a pay-in transaction, the display section 11 displays a processing selection screen (step S1201). The customer selects either processing for an envelope or processing for a check on this screen.

When the customer selects the envelope-processing (step S1202), the automatic teller apparatus 100 shifts to card processing (step S1203), and its standby is effected until the customer inserts a card therein (step S1204). The main control section 301 gives an instruction to read the contents of a card to the card reader section (not shown) (step S1205). A standby state for reading by the card reader section is effected according to the instruction to read the contents of a card (step S1206). When the customer inserts a card (step S1207), the card reader section receives the card (step S1208), and reads the contents of information stored in the card (step S1209).

The read-in card information is recorded once in the recording section 302 (step S1210). Then, a request for entering an identification number to the customer appears on the display section 11. When the customer enters the identification number (step S1211), information for the number is recorded in the recording section 302 (step S1212). The main control section 301 fetches the acquired card information as well as the identification number from the recording section 302 (step S1213), and verifies them against a database (step S1214). The verification is executed by searching the database in the higher host computer 304 through the host line processing section 303.

The verification of the information against the database is executed in the higher host computer 304 (step S1215), and when it is determined that the start of a transaction is permitted, a report to that effect is transferred to the main control section 301, and the pay-in processing with an envelope is started (step S1216). At first, the envelope carrier control section 2001 gives an instruction to wait for insertion of an envelope to the pay-in processing section 200 (step S1217). According to this instruction, a processing-enabled status of the pay-in processing section 200 is effected (step S1218). When the customer inserts an envelope into the receiving port 5 (step S1219), the pay-in processing section 200 receives the envelope (step S1220).

Then, the envelope printing control section 2002 instructs to print a character string onto the inserted envelope (step S1221). The envelope printing mechanism 253 prints a character string onto the envelope according to the instruction to print the character string onto the envelope. (Step S1222). After the printing is terminated, the envelope is carried as it is, and stored in the envelope storage section 204 of the bin 201 (step S1223).

When the storage of the envelope therein is completed (step S1224), the processing returns to the card processing (step S1225). The main control section 301 gives an instruction to return the card to the card reader section (step S1226). The card reader section carries the card to the card operating section 2 (step S1227, step S1228). At this point in time, the main control section 301 is in a state of waiting for the card to be extracted (step S1229). When the customer extracts the card, the main control section 301 determines that situation, and terminates the processing for paying-in with the envelope (step S1230).

Figure 13:
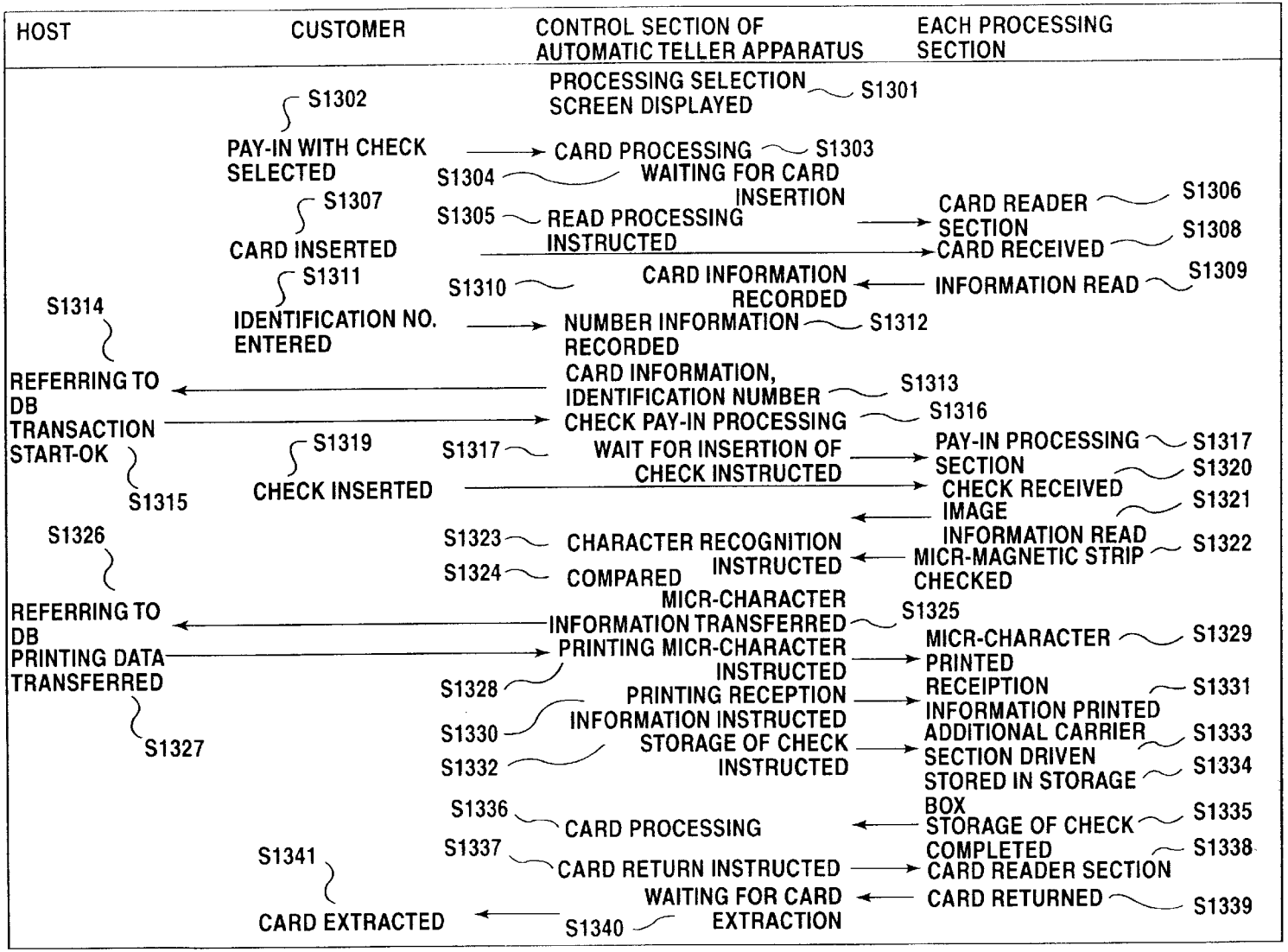
FIG. 13 is a flow chart showing the pay-in processing with a check among the operations of the automatic teller apparatus.
Figure 14:
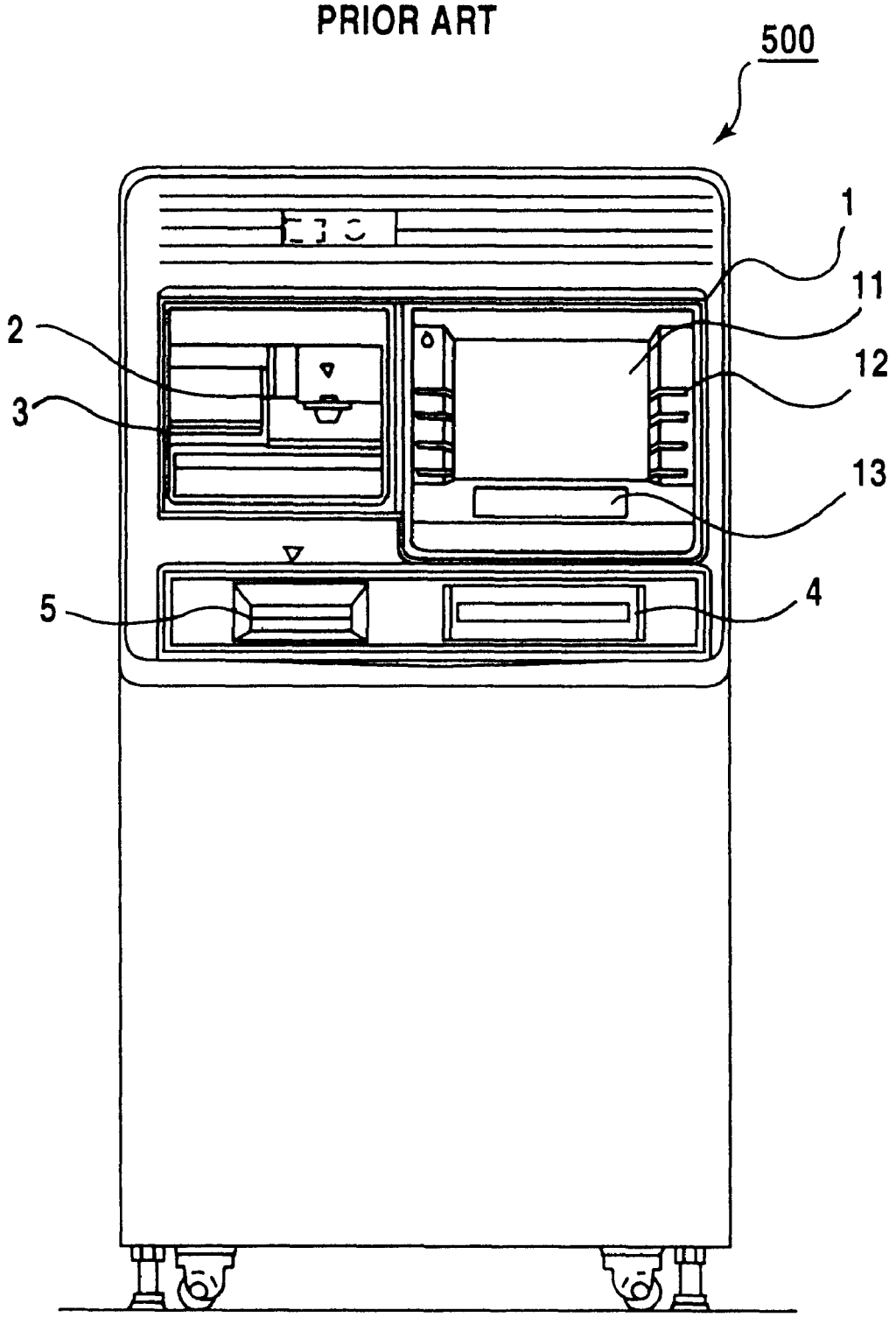
FIG.14 PRIOR ART
FIG. 14 is a front view showing an example of the conventional type of automatic teller apparatus.
Figure 15:
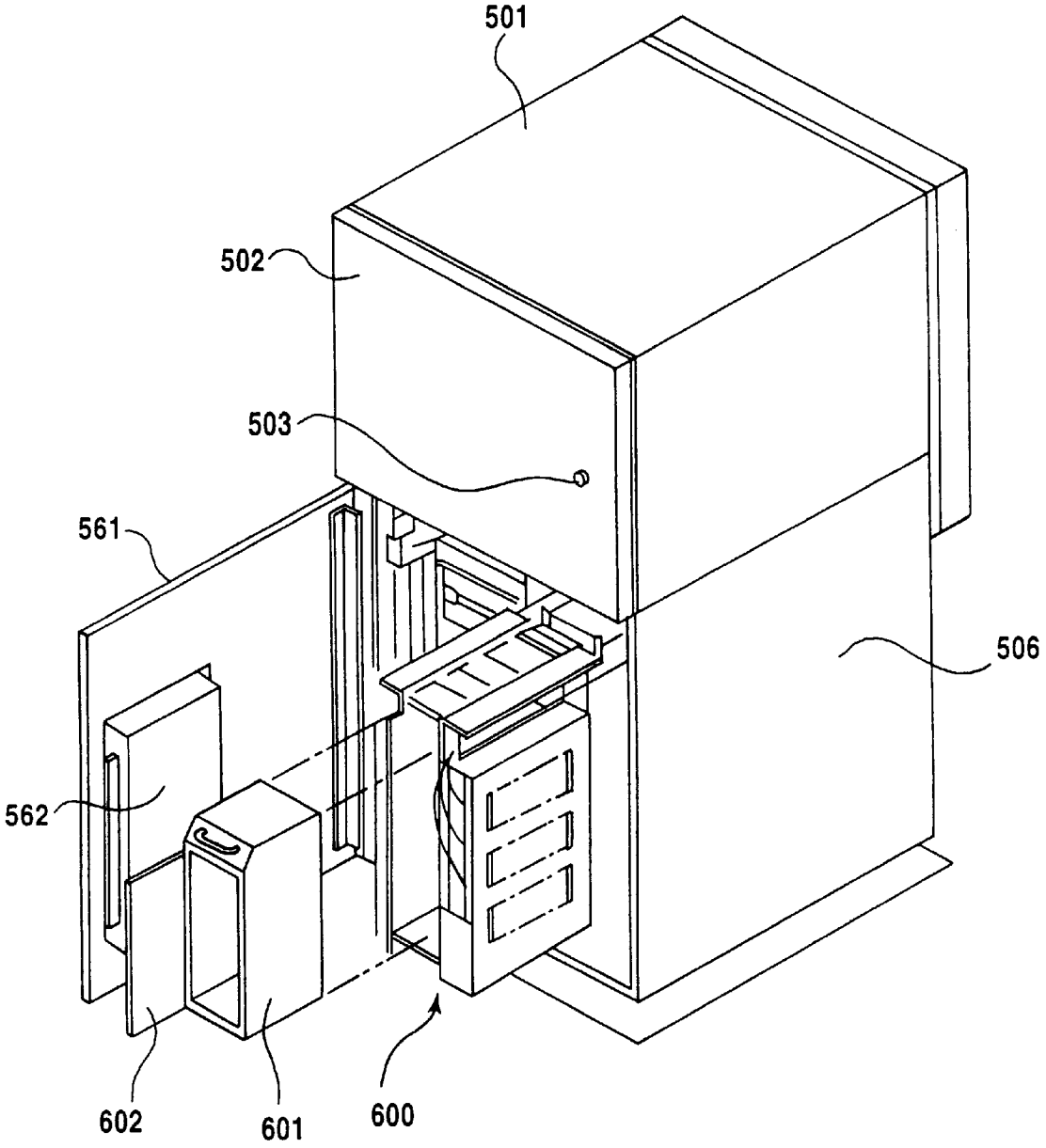
FIG.15 PRIOR ART
FIG. 15 is a rear-side perspective view showing the automatic teller apparatus shown in FIG. 14.
Figure 16:
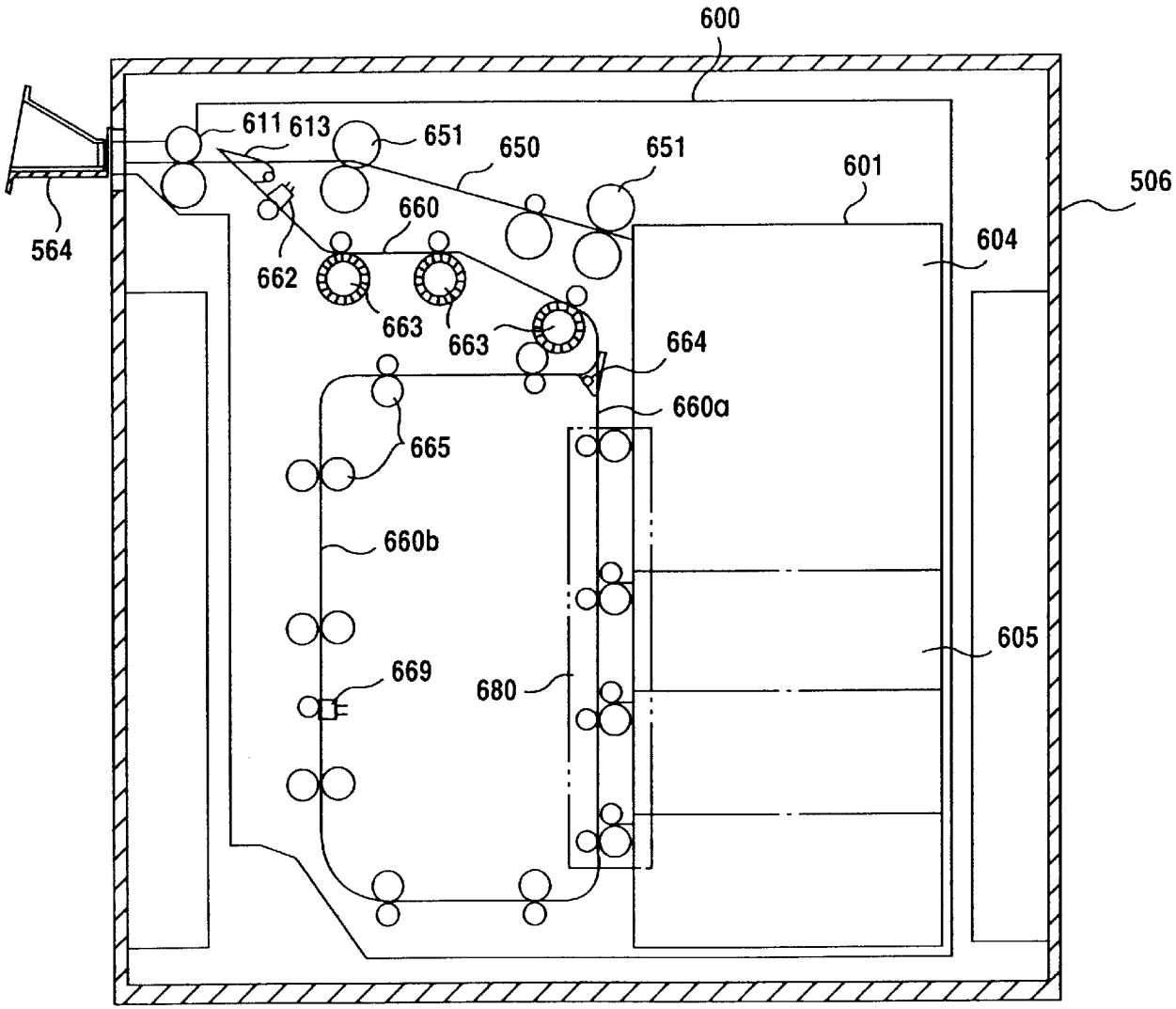
FIG.16 PRIOR ART
FIG. 16 is an explanatory view showing carrier paths in the automatic teller apparatus shown in FIG. 15.

FIG. 13 is a flow chart showing the pay-in processing with a check among the operations of the automatic teller apparatus 100. Shown in the figure from the left column are the sequence of processing in the higher host computer 304, the sequence operated by a customer, the sequence of processing executed by the control section for the automatic teller apparatus 100, and the sequence of processing executed by each processing section. When a customer selects a pay-in transaction, the display section 11 displays a processing selection screen (step S1301). The customer selects either processing for an envelope or processing for a check on this screen.

When the customer selects the check-processing (step S1302), the automatic teller apparatus 100 shifts to card processing (step S1303), and its standby is effected until the customer inserts a card therein (step S1304). The main control section 301 gives an instruction to read the contents of a card to the card reader section (not shown) (step S1305). A standby state for reading by the card reader section is effected according to the instruction to read the contents of a card (step S1306). When the customer inserts a card (step S1307), the card reader section receives the card (step S1308), and reads the contents of information stored in the card. (Step S1309).

The read-in card information is recorded once in the recording section 302 (step S1310). Then, a request for entering an identification number to the customer appears on the display section 11. When the customer enters the identification number (step S1311), information for the number is recorded in the recording section 302 (step S1312). The main control section 301 fetches the acquired card information as well as the identification number from the recording section 302 (step S1313), and verifies them against a database (step S1314). The verification is executed by searching the database in the higher host computer 304 through the host line processing section 303.

The verification of the information against the database is executed in the higher host computer 304 (step S1315), and when it is determined that the start of a transaction is permitted, a report to that effect is transferred to the main control section 301, and the pay-in processing with a check is started (step S1316). At first, the check carrier control section 2003 gives an instruction to wait for insertion of a check to the pay-in processing section 200 (step S1317). According to this instruction, a processing-enabled status of the pay-in processing section 200 is effected (step S1318). When the customer inserts a check into the receiving port 5 (step S1319), the pay-in processing section 200 receives the check (step S1320).

When having received the check, the MICR-reader 269 reads an MICR-character string of the check (step S1321). The image scanner 267 reads image information for the check (step S1322).

The main control section 301 executes character recognition, from image data for an amount column on the check as well as from image data for the MICR column, of the amount of money and the contents (an issued bank code, an issuer's code, and an issued serial number) of the MICR column (step S1323). Then, comparison is made between the contents of the MICR column subjected to the character recognition and the contents of the MICR column read by the MICR-reader 269 (step S1324). When it is determined that both of the contents are not coincident with each other, the check is returned.

When it is determined that both of the contents are coincident with each other, the main control section 301 transfers the read image information as well as the MICR character information to the higher host computer 304 (step S1325), the information is verified against the database (step S1326). The verification is executed by searching the database in the higher host computer 304 through the host line processing section 303.

The higher host computer 304 transfers, after the processing for payment is executed, printing data to the main control section 301 (step S1327). The MICR encoder control section 2007 instructs the MICR-encoder 268 to print an MICR-character string (step S1328). The MICR-encoder 268 prints the MICR-character string onto the check according to the transferred printing data (step S1329).

The check printing control section 2008 instructs the check printing mechanism 270 to print payment data onto the check (step S1330). The check printing mechanism 270 prints payment data (such as a transacted date and account number) among the printing data onto a payment data column of the check (step S1331).

Then, the check carrier control section 2003 instructs the storage mechanism 280 to store therein the check (step S1332). Also, the check carrier control section 2003 specifies the bin 201 or the storage box 7 with the check to be stored therein to the storage mechanism 280. If the storage box is detached or storage in the storage box 7 exceeds the allowable storage range, the check carrier control section 2003 specifies the check storage section 205 in the bin 201 (S1333).

The check carrier control section 2003 specifies the storage box 7 provided outside the safe otherwise. When the storage box 7 is specified, the check carrier unit control section 2009 gives an operational instruction to the check carrier unit 290. The check carrier unit 290 carries the check and stores it in the storage box 7 provided outside the safe (step S1334).

When the storage of the check has been completed (step S1335), the processing returns to the card processing (step S1336). The main control section 301 gives an instruction to return the card to the card reader section (step S1337). The card reader section carries the card to the card operating section 2 (step S1338, step S1339). At this point in time, the main control section 301 is in a state of waiting for the card to be extracted (step S1340). When the customer extracts the card, the main control section 301 determines that situation, and terminates the processing for paying-in with the check (step S1341).

Although description has been made for the check as an example in the above embodiment, this automatic teller apparatus 100 is applicable to some other monetary documents in addition to the check, such an application for transfer. Also, the steel plate as a material used for a safe has been described as an example, but the material is not limited to the steel plate if the material is hard to be machined and damaged. As for a material for the storage box 7, on the other hand, the storage box may not be made of a steel plate if the material has certain strength. For example, aluminum or resin may be used for the box.

Also, the check carrier unit 290 is located below the bin 201, but may be located above the bin 201. In this case, the position of the storage box provided outside the safe goes up. So, the upward attachment position can increase the capacity of the storage box 7 by that space.

As described above, with the automatic teller apparatus according to the present invention, particular monetary documents, such as checks, are located in the first storage section which is easily opened/closed or attached/detached, so that the checks are easily collected. And for this reason circulation of checks can be enhanced, and the processing for payment by checks can smoothly be performed.

With the automatic teller apparatus according to another aspect of the present invention, particular monetary documents, such as checks, are stored in the first storage section with a simple lock provided on the door thereof, so that the checks are easily collected. For this reason circulation of checks can be enhanced, and the processing for payment by checks can smoothly be performed.

With the automatic teller apparatus according to another aspect of the present invention, particular monetary documents, such as checks, are stored in the first storage section with a hand-operated lock unit provided on the door thereof in place of a simple lock, so that the checks are easily collected. For this reason circulation of checks can be enhanced, and the processing for payment by checks can smoothly be performed.

In the automatic teller apparatus according to another aspect of the present invention, particular money documents, such as checks, are carried by the auxiliary carrier section to be stored in the first storage section. The first storage section is easily opened/closed and attached/detached. Accordingly, checks, or the like, can easily be collected, and a maintenance serviceman can more easily carry out collection of checks. For this reason circulation of checks can be enhanced, and the processing for payment by checks can smoothly be performed.

In the automatic teller apparatus according to another aspect of the present invention, particular monetary documents, such as checks, are carried by the auxiliary carrier section to be stored in the first storage section. Also, a simple lock is provided on the door of the first storage section. Accordingly, checks, or the like, can easily be collected, and a maintenance serviceman can more easily carry out collection of checks. And for this reason circulation of checks can be enhanced, and the processing for payment by checks can smoothly be performed.

In the automatic teller apparatus according to another aspect of the present invention, the auxiliary carrier section is controlled in correlation to the operations of the main carrier section, so that particular monetary documents can accurately be carried as far as the first storage section.

In the automatic teller apparatus according to another aspect of the present invention, a plurality of blades each made of an elastic body with high friction provided in the auxiliary carrier section in the radial direction of a rotor, so that the blades contact a check during its being carried, and for this reason the check can accurately be carried.

In the automatic teller apparatus according to another aspect of the present invention, a de-electrifying brush for removing static electricity built up on a monetary document is provided in the auxiliary carrier section, so that even if checks or the like are electrified, they are not directed to any unrequired places.

In the automatic teller apparatus according to another aspect of the present invention, a particular monetary document inserted into an inserting port is carried to the storage box provided outside the safe through the first carrier path and second carrier path selected by a switch lever. This storage box is detachable and is provided outside the safe, so that checks can easily be collected. And for this reason circulation of checks can be enhanced, and the processing for payment by checks can smoothly be performed.

In the automatic teller apparatus according to another aspect of the present invention, the auxiliary carrier section is controlled by the dedicated control section, so that the auxiliary carrier section and the dedicated control section can be handled as one unit. Also, if connected to the control section, the auxiliary carrier section can be operated in accordance with operations of other devices. By discretely controlling the auxiliary carrier section, as described above, the auxiliary carrier section can be attached and detached for exchange thereof.

This application is based on Japanese Patent Application No. HEI 10-101398, filed in the Japanese Patent Office on Apr. 13, 1998, the entire contents of which are hereby incorporated by reference.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An automatic teller apparatus for automatically transacting a monetary document with a customer without assistance of an attendant comprising:

a main carrier section operative to carry formatted envelopes, checks, and other monetary documents;

an auxiliary carrier section separate from said main carrier section and being operative to carry particular monetary documents among the monetary documents;

a first storage section connected to the auxiliary carrier section for receiving therefrom and for storing said particular monetary documents and being easily opened and closed or attached and detached; and a second storage section separate from said first storage section and being connected to the main carrier section for receiving therefrom and for storing monetary documents other than said particular monetary documents and harder to be opened and closed than at least the first storage section.

2. An automatic teller apparatus according to claim 1 further comprising:

a main carrier section controller for controlling operations of said main carrier section; and an auxiliary carrier section controller for controlling operations of said auxiliary carrier section in correlation to the operations of said main carrier section.

3. An automatic teller apparatus for automatically transacting a monetary document with a customer without the assistance of an attendant comprising:

a main carrier section operative to carry formatted envelopes, checks, and other monetary documents;

an auxiliary carrier section operative to carry particular monetary documents among the monetary documents;

a first storage section connected to the auxiliary carrier section for receiving therefrom and for storing said particular monetary documents and being easily opened and closed or attached and detached; and a second storage section connected to the main carrier section for receiving therefrom and for storing monetary documents other than said particular monetary documents and harder to be opened and closed than at least the first storage section, wherein said auxiliary carrier section contains an impeller provided with a rotor and a plurality of blades, each made of an elastic body with high friction, extending in a radial direction of said rotor for contacting a monetary document.

4. An automatic teller apparatus for automatically transacting a monetary document with a customer without assistance of an attendant comprising:

a main carrier section operative to carry formatted envelopes, checks, and other monetary documents;

an auxiliary carrier section operative to carry particular monetary documents among the monetary documents;

a first storage section connected to the auxiliary carrier section for storing said particular monetary documents and being easily opened and closed or attached and detached;

a second storage section connected to the main carrier section for storing therein monetary documents other than said particular monetary documents and harder to be opened and closed than at least the first storage section.

wherein a de-electrifying brush for removing static electricity built up on the monetary document is further provided in said auxiliary carrier section.

5. An automatic teller apparatus for automatically transacting a monetary document with a customer without assistance of an attendant comprising:

a main carrier section operative to carry formatted envelopes, checks, and other monetary documents;

an auxiliary carrier section branching from the main carrier section operative to carry particular monetary documents among said monetary documents;

a first storage section connected to the auxiliary carrier section for receiving therefrom and for storing said particular monetary documents and having a simple lock provided on a door thereof; and a second storage section separate from the first storage section and being connected to the main carrier section for receiving therefrom and for storing monetary documents other than said particular monetary documents and having a firm and complicated lock provided on a door thereof.

6. An automatic teller apparatus according to claim 5 further comprising:

a main carrier section controller for controlling operations of said main carrier section; and an auxiliary carrier section controller for controlling operations of said auxiliary carrier section in correlation to the operations of said main carrier section.

7. An automatic teller apparatus for automatically transacting a monetary document with a customer without assistance of an attendant comprising:

a main carrier section operative to carry formatted envelopes, checks, and other monetary documents;

an auxiliary carrier section branching from the main carrier section operative to carry particular monetary documents among said monetary documents;

a first storage section connected to the auxiliary carrier section for storing said particular monetary documents and having a simple lock provided on a door thereof; and a second storage section connected to the main carrier section for storing therein monetary documents other than said particular monetary documents and having a firm and complicated lock provided on a door thereof, wherein said auxiliary carrier section contains an impeller provided with a rotor and a plurality of blades, each made of an elastic body with high friction, extending in a radial direction of said rotor for contacting said blades with a monetary document.

8. An automatic teller apparatus for automatically transacting a monetary document with a customer without assistance of an attendant comprising:

a main carrier section operative to carry formatted envelopes, checks, and other monetary documents;

an auxiliary carrier section branching from the main carrier section and being operative to carry particular monetary documents among said monetary documents;

a first storage section connected to the auxiliary carrier section for storing said particular monetary documents and having a simple lock provided on a door thereof; and a second storage section connected to the main carrier section for storing therein monetary documents other than said particular monetary documents and having a firm and complicated lock provided on a door thereof, wherein a de-electrifying brush for removing static electricity built up on the monetary document is further provided in said auxiliary carrier section.

9. An automatic teller apparatus comprising:

an inserting port for inserting therein formatted envelopes, checks, and other monetary documents;

a first carrier section for carrying particular monetary documents;

a second carrier section for carrying monetary documents other than the particular monetary documents;

a switch lever for switching disposed behind the inserting port and between the first carrier section and the second carrier section;

a storage section provided at an end of the second carrier section;

a safe for holding at least the storage section inside thereof;

an opening section provided on a wall of the safe or on a door thereof;

an auxiliary carrier section branching from the first carrier section and reaching the opening section;

a storage box provided outside the safe and detachably attached to the opening section for storing the particular monetary documents; and a control section for controlling operations of the first and second carrier sections, of the switch lever, and of the auxiliary carrier section.

10. An automatic teller apparatus comprising:

an inserting port for inserting therein formatted envelopes, checks, and other monetary documents;

a first carrier section for carrying particular monetary documents;

a second carrier section for carrying monetary documents other than the particular monetary documents;

a switch lever for switching disposed behind the inserting port and between the first carrier section and the second carrier section;

a control section for controlling operations of the first and second carrier sections, and of the switch lever;

a storage section provided at an end of the second carrier section;

a safe for holding at least the storage section inside thereof;

an opening section provided on a wall of the safe or on a door thereof;

an auxiliary carrier section branching from the first carrier section and reaching the opening section;

a dedicated control section provided in the auxiliary carrier section for controlling operations of said auxiliary carrier section; and a storage box provided outside the safe and detachably attached to the opening section for storing the particular monetary documents.

* * * * *